US009995437B2

(12) United States Patent
Krijn et al.

(10) Patent No.: US 9,995,437 B2
(45) Date of Patent: Jun. 12, 2018

(54) LED BULB

(71) Applicant: PHILIPS LIGHTING HOLDING B.V., Eindhoven (NL)

(72) Inventors: Marcellinus Petrus Carolus Michael Krijn, Eindhoven (NL); Siebe Tjerk De Zwart, Eindhoven (NL); Tim Dekker, Eindhoven (NL); Alexander Jacobus Mariette Van Neer, Eindhoven (NL); Jochen Renaat Van Gheluwe, Eindhoven (NL); Hendrikus Hubertus Petrus Gommans, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days. days.

(21) Appl. No.: 15/114,200

(22) PCT Filed: Jan. 26, 2015

(86) PCT No.: PCT/EP2015/051424

§ 371 (c)(1),
(2) Date: Jul. 26, 2016

(87) PCT Pub. No.: WO2015/113913

PCT Pub. Date: Aug. 6, 2015

(65) Prior Publication Data

US 2017/0002985 A1 Jan. 5, 2017

(30) Foreign Application Priority Data

Jan. 29, 2014 (EP) ..... 14153059

(51) Int. Cl.
*F21K 9/235* (2016.01)
*F21V 29/506* (2015.01)
(Continued)

(52) U.S. Cl.
CPC ..... *F21K 9/235* (2016.08); *F21K 9/232* (2016.08); *F21K 9/238* (2016.08); *F21V 3/061* (2018.02);
(Continued)

(58) Field of Classification Search
CPC ..... F21K 9/238; F21K 9/232; F21Y 2107/30; F21V 29/506
See application file for complete search history.

(56) References Cited

U.S. PATENT DOCUMENTS

| | | | | |
|---|---|---|---|---|
| 9,303,824 | B2 * | 4/2016 | Sun | F21V 29/83 |
| 9,657,922 | B2 * | 5/2017 | Negley | F21V 15/00 |
| 9,759,388 | B2 * | 9/2017 | Berends | F21K 9/232 |
| 9,845,933 | B2 * | 12/2017 | Lin | F21V 3/02 |
| 2010/0314985 | A1 * | 12/2010 | Premysler | F21V 29/402 313/46 |

(Continued)

FOREIGN PATENT DOCUMENTS

| | | | |
|---|---|---|---|
| CN | 202303274 | U | 7/2012 |
| DE | 102007040444 | A1 | 3/2009 |

(Continued)

OTHER PUBLICATIONS

Machine translation of Sokolov, WO 2013/109161 A1, published Jul. 25, 2013.*

*Primary Examiner* — William N Harris
(74) *Attorney, Agent, or Firm* — Akarsh P. Belagodu

(57) ABSTRACT

An LED light bulb has a light emitting bulb part 22 which comprises a central core 24 running from the top towards the bottom and which provides an open passageway at least at the top. The LEDs are mounted in thermal contact around the central core 24. This design provides an air flow to promote cooling of the LEDs. This in turn enables a reduced size and cost of the heat sink, or avoids the need for a heat sink altogether.

12 Claims, 5 Drawing Sheets

(51) Int. Cl.

| | |
|---|---|
| ***F21V 29/83*** | (2015.01) |
| ***F21K 9/232*** | (2016.01) |
| ***F21K 9/238*** | (2016.01) |
| ***F21Y 115/10*** | (2016.01) |
| ***F21V 23/00*** | (2015.01) |
| ***F21V 3/06*** | (2018.01) |
| ***F21V 19/00*** | (2006.01) |
| *F21Y 107/30* | (2016.01) |

(52) U.S. Cl.
CPC ..... *F21V 19/005* (2013.01); *F21V 23/005* (2013.01); *F21V 29/506* (2015.01); *F21V 29/83* (2015.01); *F21Y 2107/30* (2016.08); *F21Y 2115/10* (2016.08)

(56) References Cited

U.S. PATENT DOCUMENTS

| | | | | |
|---|---|---|---|---|
| 2012/0049732 | A1* | 3/2012 | Chuang | F21V 29/83 315/32 |
| 2013/0016508 | A1* | 1/2013 | Progl | F21V 3/02 362/235 |
| 2013/0154465 | A1 | 6/2013 | Anderson | |
| 2017/0191624 | A1* | 7/2017 | Crayford | F21K 9/238 |

FOREIGN PATENT DOCUMENTS

| | | | |
|---|---|---|---|
| JP | 2004296245 | A | 10/2004 |
| KR | 2010003326 | A | 1/2010 |
| WO | WO2013007815 | A1 | 1/2013 |
| WO | WO2013109161 | A1 | 7/2013 |

* cited by examiner

LED BULB

CROSS-REFERENCE TO PRIOR APPLICATIONS

This application is the U.S. National Phase application under 35 U.S.C. § 371 of International Application No. PCT/EP2015/051424, filed on Jan. 26, 2015, which claims the benefit of European Patent Application No. 14153059.2, filed on Jan. 29, 2014. These applications are hereby incorporated by reference herein.

FIELD OF THE INVENTION

The present invention relates generally to a light emitting diode (LED) bulb, and in particular to cooling an LED lamp.

BACKGROUND

Recently there has been a trend in replacing conventional incandescent light bulbs with LED bulbs. The replacement of conventional incandescent light bulbs with one or more LEDs is desirable because incandescent bulbs are inefficient relative to LEDs, e.g., in terms of energy use and longevity.

LED bulbs also offer the possibility to employ two or more groups or "channels" of LEDs which produce light of different colors, each controllably supplied with predetermined currents to enable the generation and mixing of light to produce general illumination with desired attributes or a desired lighting effect. Thus, LEDs offer more versatile lighting solutions.

While it is desirable to replace incandescent light bulbs with LEDs, there are many lighting fixtures, however, where replacement is difficult because of the operating conditions. In particular, heat management is critical. For example, in domestic lighting applications, a bulb is often recessed into a housing. This is particularly the case for spot lamps.

The standard solution is to provide heat sinking structures for dissipating excess heat.

The price of LED-based bulbs has reached a level that makes it affordable for consumers. There is however fierce competition among manufacturers of these bulbs, and a huge pressure to reduce the cost price of the bulbs. Despite recent cost reductions, LED bulbs are still relatively expensive. This is mainly the result of the price of the components such as the heat sinks, the LEDs, the driver, the printed circuit board (PCB), as well as the cost associated with mounting the components.

A reduction in cost price is made possible for example by using a light source in the form of a linear array of electrically connected LEDs on a thin and narrow flexible substrate. In this way, the LEDs can be mounted (soldered) in a continuous linear process. During the process, also a phosphor can be applied (e.g. by dip-coating and drying). Afterwards, the long line of LEDs can be cut to length.

The length then determines the light output of the bulb. The main problem with this proposition is that such a line of LEDs is difficult to cool.

What is needed is a LED lamp that can be manufactured at low cost but which can also efficiently dissipate heat, and without requiring costly heat sinking structures.

SUMMARY OF THE INVENTION

The invention is defined by the claims.

According to an example, there is provided an LED light bulb comprising:

a base which includes an electrical connector;

a light emitting bulb part having a bottom facing the base and a top;

a driver circuit electrically connected to the electrical connector; and a set of LEDs electrically connected to the driver circuit, wherein the light emitting bulb part comprises a hollow central core which is open to the top of the light emitting bulb part, and a chamber surrounding the central core, wherein the chamber (25) comprises a closed volume and has an annular part around the central core (24), and wherein a radially innermost wall of the annular part defines the hollow central core, and wherein the LEDs are mounted around the central core.

The invention provides cooling by using air flow within a hollow core. The heating caused by the LEDs promotes air flow by convection, thus providing a continuous supply of cooler air for cooling the LEDs.

The invention enables a low-cost LED-based light bulb.

In a first example, the hollow central core runs from top to bottom and provides an open passageway between the top and bottom, and the base comprises air flow openings which are in communication with the open passageway. In this way, air can flow completely through the central core of the light emitting bulb part.

In a second example, the hollow central core has a closed base, and extends from the top of the light emitting bulb part to at least half way into the depth of the light emitting bulb part. In this example, air flow caused by convection currents still flow within the core to promote cooling.

By providing a central core with a surrounding chamber, the light emitting bulb part can in one example have a shape defined as a surface of revolution generated by revolving a closed shape in three-dimensional space about a top-bottom axis. Thus, this is a torus-like shape (but the revolved shape is not necessarily a circle). Thus, the light emitting bulb part can have a shape which is fully rotationally symmetric about the top-bottom axis.

The chamber can comprise a closed annular volume, with an annular part around the central core, and a radially innermost wall of the annular part defines the central core. Thus, the shape of the chamber itself defines the core, which extends through the full height or only part of the height of the light emitting bulb part. The LEDs can then be provided around the radially innermost wall such that the LEDs are housed within the annular volume. In this way, the LEDs are mounted within the chamber and thus not exposed to the external environment.

In one example, the closed volume of the chamber is completely defined by a glass wall, through which pass electrical connections to the LEDs.

In another example, the closed volume of the chamber is defined by a glass wall having an open base, and a base cover which closes the open base, but leaves an open passage to the central core. This can be simpler to manufacture, as a cup-shaped glass part, which is closed with a cover. The base cover can for example comprise a plastic ring.

In another example, the closed volume of the chamber can be defined by an inner cylinder, which defines the innermost wall (i.e. the central core), and an outer wall around the inner cylinder. By providing a separate part to define the inner core, the LEDs can be mounted on the core before the bulb is assembled. This can reduce manufacturing cost. The inner cylinder can be plastic, metal or ceramic, and the outer wall can be glass.

In all examples, the LEDs can comprise a string of LEDs provided on a flexible substrate. This flexible substrate can then be wound around the surface of the inner core. In particular, the flexible substrate is preferably mounted in contact with a radially innermost wall which defines the central core. This contact provides thermal coupling between the LED substrate and the air flow passageway.

Instead of providing LEDs on a flexible carrier, the inner cylinder can comprise conductive tracks on which the LEDs are mounted. The inner cylinder then functions as the circuit board for the LEDs, which can then be mounted over the cylinder as discrete components. This can further reduce the component count.

In one example an air permeable membrane can be fitted across the open top and/or the open bottom of the hollow central core to filter the air and thus prevent contaminants and impurities from entering the hollow core. This may reduce the effect of dust collecting on the surface of the hollow central core, the dust acts as a thermal insulator and impedes airflow thus reducing the amount of heat dissipation achievable by the hollow core.

BRIEF DESCRIPTION OF THE DRAWINGS

Examples of the invention will now be described in detail with reference to the accompanying drawings, in which.

DETAILED DESCRIPTION

Figure 1:
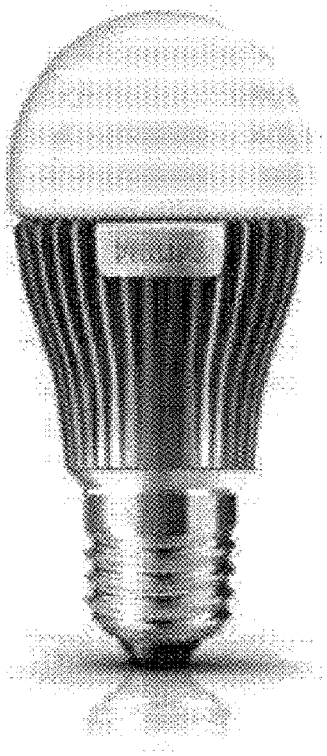
FIG. 1 shows a known LED light bulb.
Figure 1:
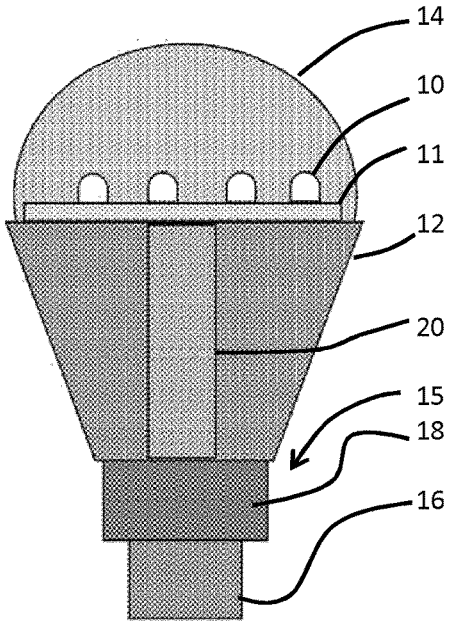

FIG. 1 shows known an LED-based alternative to incandescent light bulbs, particularly A55 and A60 types. The outer appearance is shown on the left, and the internal components are shown schematically on the right. This is known as the MASTER LED bulb available from Koninklijke Philips N.V. The bulb includes a plurality of LED light sources 10 provided on a circuit board 11, which is disposed over a heat sink 12. The LEDs emit dimmable light towards a diffusing dome cover 14.

The bulb has a base which includes an electrical connector 16 and driver circuitry 18 which connects to the LEDs through conduit 20. The driver circuitry comprises an AC/DC converter that converts the AC power from the electrical connector to DC power. In this example, the driver circuitry additionally comprises dimming control circuitry, for example implemented using pulse width modulation (PWM). However, a dimming function is not an essential feature.

The heat sink 12 is a significant contributor to the cost of the bulb.

The invention provides an LED light bulb in which the light emitting bulb part comprises a central core running from the top and which provides an open passageway at least to the top. The LEDs are mounted in thermal contact around the central core. In one arrangement, core runs from top to bottom and the base electrical connector comprises air flow openings which are in communication with the open passageway. In another arrangement, the core only extends partly into the depth of the light emitting bulb part. These arrangements both provide air flow conditions which promote cooling of the LEDs. This in turn enables a reduced size and cost of the heat sink, or avoids the need for a heat sink altogether.

Figure 2:
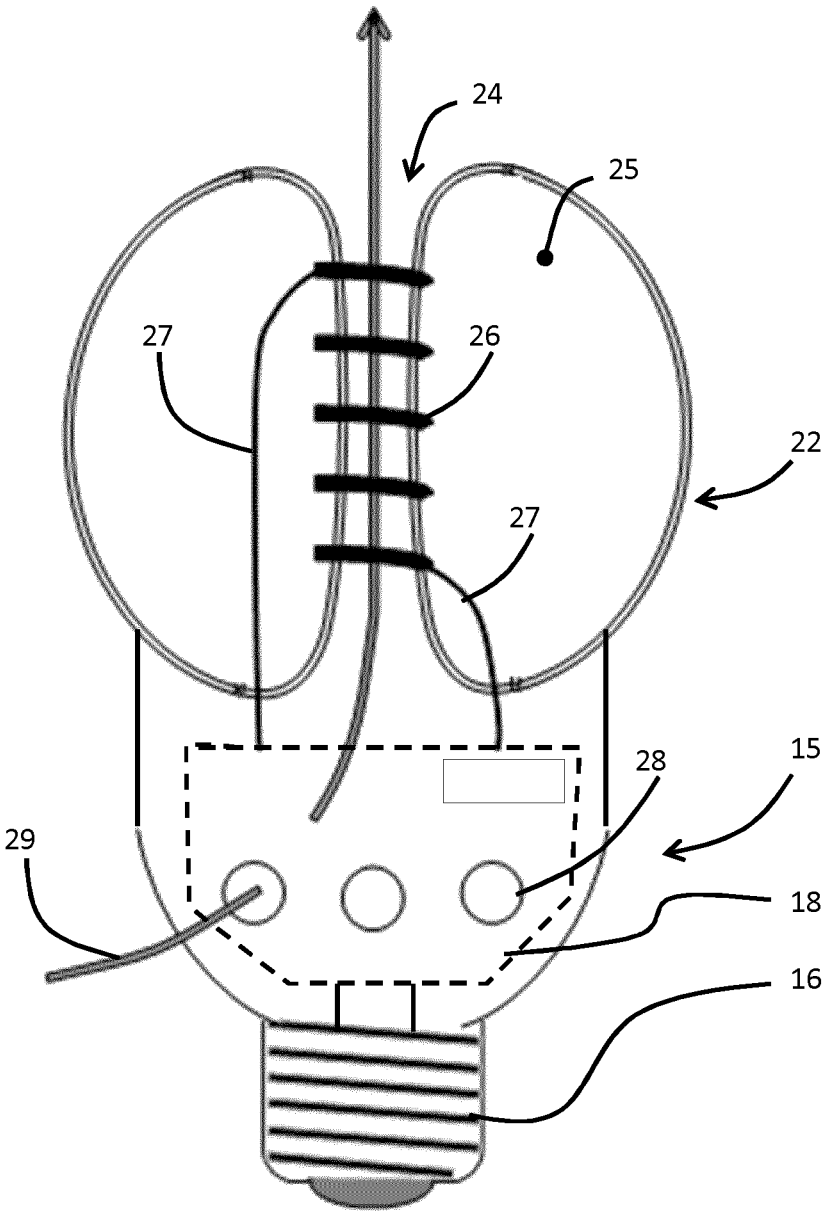
FIG. 2 shows a first example of an LED light bulb of the invention.

FIG. 2 shows a first example of an LED light bulb of the invention. The same reference numbers are used as in FIG. 1 for the same components.

The LED light bulb again comprises a base 15 which includes an electrical connector 16, which is for connecting the bulb to a corresponding electrical socket. A screw fitting is shown, but it may equally be a bayonet fitting, any other twist and lock connection or a push fit connection. The electrical connector 16 supplies an LED driver 18, which may be of conventional design. The driver electronics is not described in this application, since standard off-the-shelf components can be used. The invention relates to the configuration of the LEDs and the light emitting bulb part, and for this reason no detailed discussion is provided concerning the electrical circuits and connections.

The light emitting bulb part is shown as 22 and it has a bottom facing the base 15 and a top.

In this example, the light emitting bulb part has a hollow central core 24 running from top to bottom and which provides an open passageway between the top and bottom. A chamber 25 surrounds the core 24, and the LEDs are mounted around the central core 24. In the example of FIG. 2, the LEDs are mounted on a flexible carrier 26 as a linear strip which is wound around the core within the chamber 25. The leads 27 to the ends of the linear strip pass through the wall of the chamber.

The base comprises air flow openings 28 which are in communication with the open passageway defined by the central core 24.

The design provides cooling by using air flow 29 through a passageway running through the light emitting bulb part 22. The heating caused by the LED promotes air flow by convection, thus providing a continuous supply of cooler air for cooling the LEDs.

The light emitting bulb part is preferably rotationally symmetric, so that it has a shape formed by rotating a shape (i.e. the near semicircles to each side of the central core) around the top-bottom axis. This gives a torus-like shape. The base 15 and the light emitting bulb part 22 are bonded together.

In the example of FIG. 2 the chamber 25 comprises a closed annular volume, and a radially innermost wall defines the central core 24. Thus, the shape of the chamber itself defines the core. The light emitting bulb part can be made of a single piece of material or two or more pieces. The bulb part typically has a glass outer wall, although the outer wall can be plastic or a translucent ceramic such as a densely sintered alumina.

The LEDs are located close to the central core 24 so that heat transport between the LEDs and the air flow 29 in the core takes place. The substrate carrying the linear array of electrically connected LEDs is preferably in contact with the radially innermost wall which defines the central core 24.

The chamber 25 is closed, and it can thus be filled with a gas that promotes convection inside the bulb, thereby leading to an improved heat transfer from the LEDs to the bulb (as compared to air). Such gas can be Helium, for example.

The material of the light emitting bulb part can be translucent (i.e. scattering) to mask the individual LED sources.

The surface of the inner wall or the outer wall of the central core can be coated with a material promoting heat conduction or heat transfer to the air. This coating can be a metal (e.g. aluminium) or a polymer layer with improved thermal conducting properties.

Figure 3:
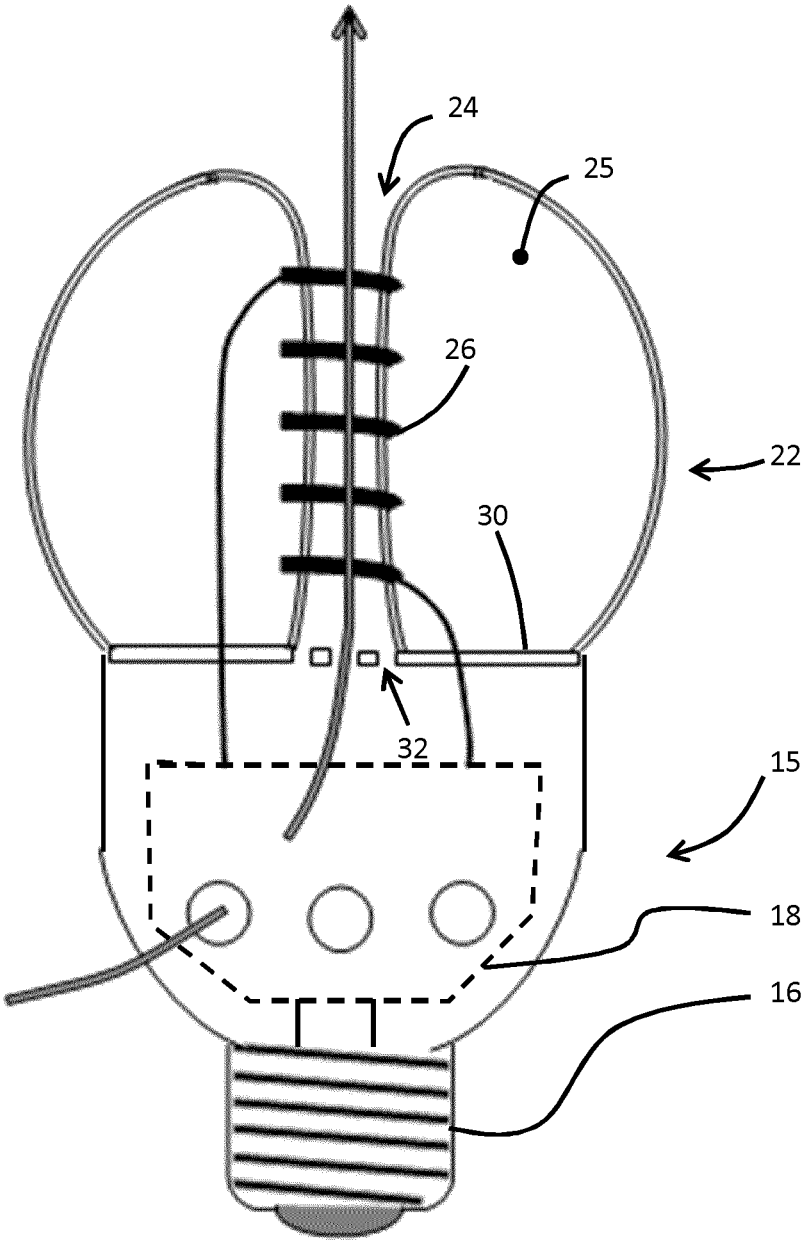
FIG. 3 shows a second example of an LED light bulb of the invention.

In the example of FIG. 2, the chamber 25 needs to be closed after the LEDs have been mounted inside. An alternative which can give a lower cost manufacturing method is explained with reference to FIG. 3.

In this case, the light emitting bulb part 22 is open at the lower side. The opening can be closed by means of a plastic ring 30 that has a central hole or set of holes 32 to let air through for the convective cooling.

In this example, the closed volume of the chamber is defined by a wall (e.g. glass) having an open base, and a base cover which closes the open base, but leaves an open passage to the central core. This is simpler to manufacture because an open cup-shaped glass part can be used, which is closed with a cover.

Another example explained with reference to FIG. 4 makes use of a separate component to define the central core 24.

This separate component comprises an inner cylinder 34, which defines the innermost wall. The glass part forms an outer wall around the inner cylinder. By providing a separate part to define the inner core, the LEDs can be mounted on the core before the bulb is assembled. This can reduce manufacturing cost. The inner cylinder can be plastic, metal or ceramic, and the outer wall can be glass.

The examples above all make use of a hollow central core in the form of a passageway which extends fully through the light emitting bulb part, running from top to bottom and providing an open passageway between the top and bottom. Air flow openings are in communication with the open passageway to provide an air flow through the core. However, improved cooling based on convective air currents can also be induced by the core even if it is only open at one end.

Figure 5:
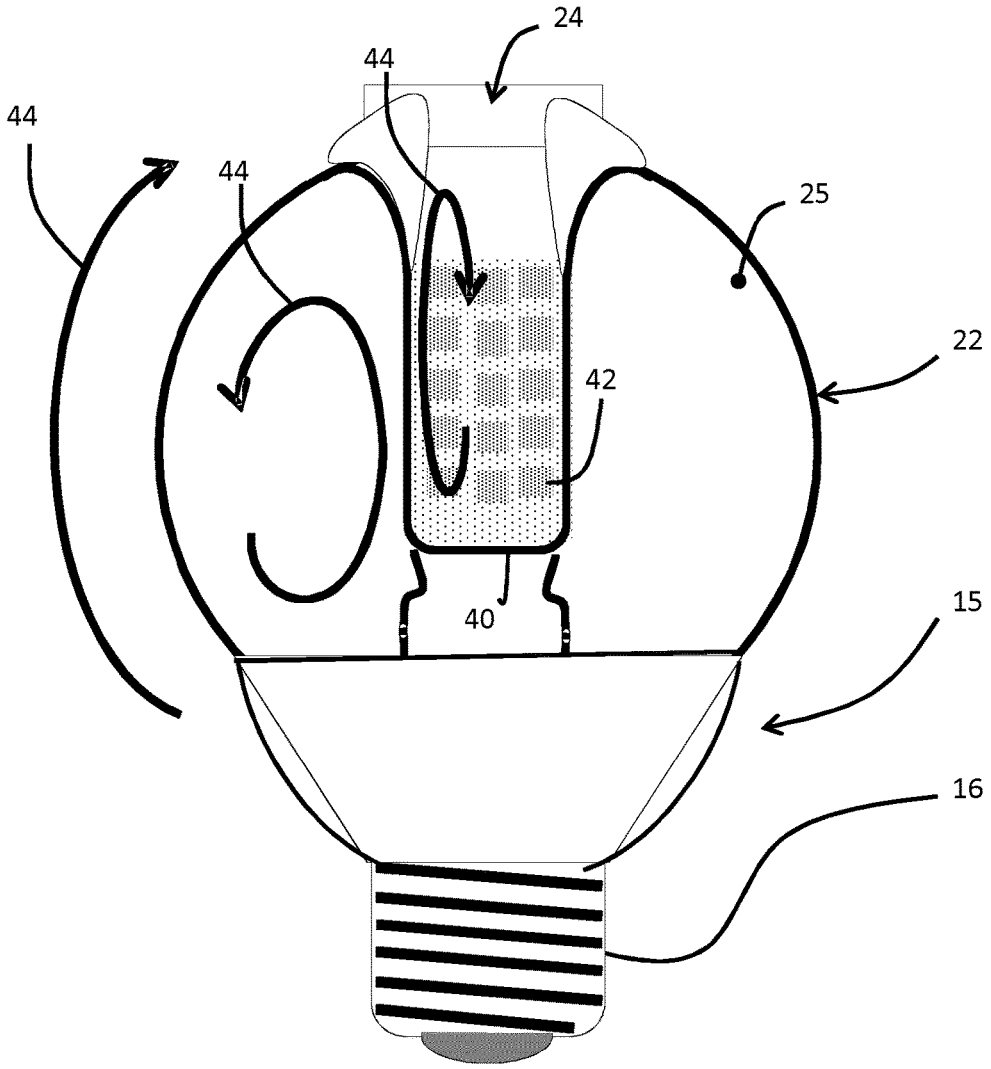
FIG. 5 shows a fourth example of an LED light bulb of the invention.

FIG. 5 shows a further example in which the central core 24 has a closed base 40, and the hollow core extends from the top of the light emitting bulb part 22 only partially into the depth of the light emitting bulb part. In this way, the core provides a cylindrical indentation. For example, it may extend at least half way into the light emitting bulb part. The LEDs 42 are again within the closed chamber 25 of the light emitting bulb part 22, mounted around the inner wall which defines the core. The LEDs can be mounted on a foil-type PCB that is deformed into a cylinder. This cylinder is located close to or in contact with the inner wall which defines the cylindrical shaped indentation in the bulb.

The light emitting bulb part 22 is not completely annular, but it has an annular part around the core 24. The inner wall of the chamber in this annular part again defines the core.

This is another design which can be made with very low-cost, and still provide improved cooling of the LEDs. The arrows 44 show the convective gas flow. The core gives rise to an improved conduction of heat generated near the inner parts of the closed chamber towards the outer parts that are accessible by convective air flow.

In all examples, the LEDs can comprise a string of LEDs provided on a flexible substrate. This flexible substrate can then be wound around the surface of the inner core. In particular, the flexible substrate is preferably mounted in contact with the radially innermost wall which defines the central core. This contact provides thermal coupling between the LED substrate and the air flow passageway.

Figure 4:
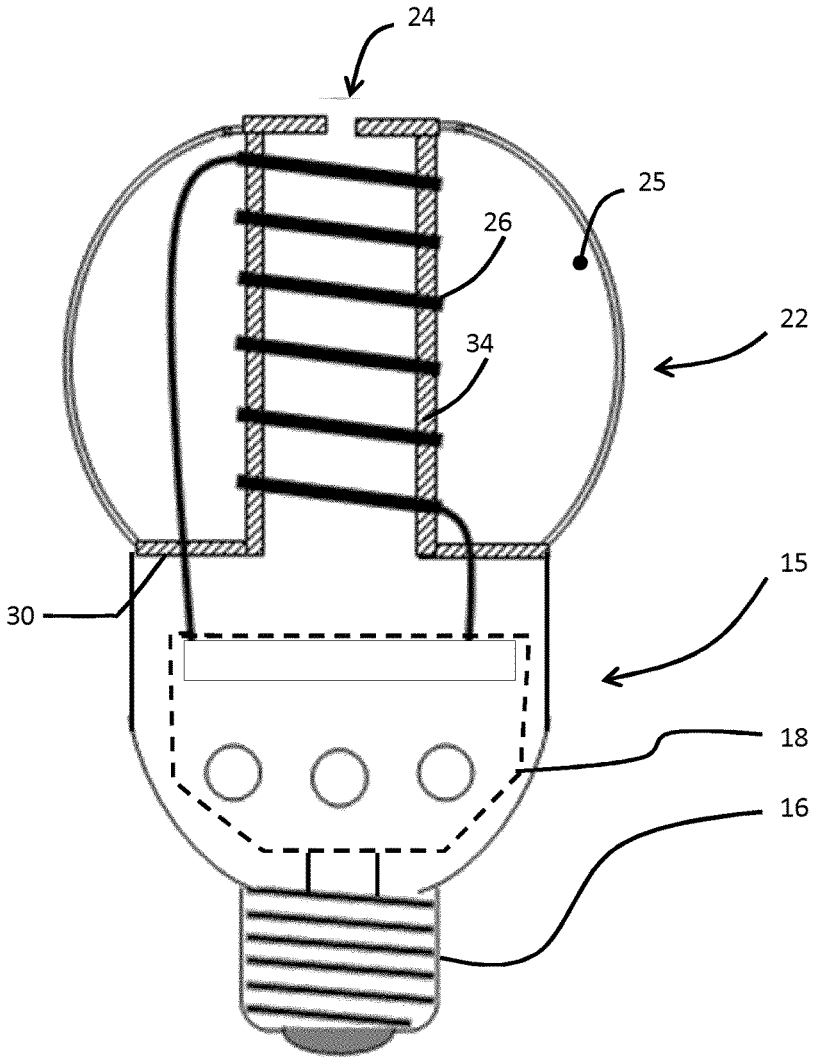
FIG. 4 shows a third example of an LED light bulb of the invention.

Instead of providing LEDs on a flexible carrier, the inner cylinder of the example of FIG. 4 can comprise conductive tracks on which the LEDs are mounted. The inner cylinder then functions as the circuit board for the LEDs, which can then be mounted over the cylinder as discrete components. This can further reduce the component count.

The design of FIG. 4 means that the bulb is particularly easy and low-cost to make. The cylinder can be pre-assembled with the linear LED array or the discrete LEDs into a component that can be inserted and glued into the bulb easily. The LEDs can be in good thermal contact with the cylinder by using a thermal adhesive. This design also gives more freedom in the choice of materials and dimensions for the bulb and cylinder to result in the most efficient design from a thermal point of view.

In the examples above, the central core defines a straight passageway running from the top towards the bottom of the light emitting part of the bulb. This is the easiest form to manufacture, since the part of the bulb around the core can be rotationally symmetric around the core. However, the core may take other forms. For example, there may be a central opening at the base. or a central closed end of the core, but the passageway may branch laterally so that the opening in the top is not at the very tip of the bulb. The passageway may be made less visible by displacing the top from the very tip of the bulb.

The outer envelope of the bulb is preferably designed with scattering properties to mask the appearance of the discrete LEDs inside. However, a clear outer envelope can also be used. If the LEDs are provided on the inside surface of a cylindrical tube, the tube itself can have scattering properties, so that a clear outer envelope can be used.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

Any reference signs in the claims should not be construed as limiting the scope.

The invention claimed is:

1. An LED light bulb, comprising:

a base which includes an electrical connector;

a light emitting bulb part having a bottom facing the base and a top;

a driver circuit electrically connected to the electrical connector; and a set of LEDs electrically connected to the driver circuit, wherein the light emitting bulb part comprises a hollow central core which is open to the top of the light emitting bulb part, and a chamber surrounding the central core, wherein the chamber comprises a closed volume and has an annular part around the central core, and wherein a radially innermost wall of the annular part defines the hollow central core, and wherein the LEDs are mounted around the central core, and wherein the hollow central core has a closed base, and extends from the top of the light emitting bulb part only partially into a depth of the light emitting bulb part.

2. A bulb as claimed in claim 1, wherein the LEDs are provided around the radially innermost wall such that the LEDs are housed within the closed volume.

3. A bulb as claimed in claim 1, wherein the closed volume of the chamber is completely defined by a wall, through which pass electrical connections to the LEDs.

4. A bulb as claimed in claim 3, wherein the wall is glass.

5. A bulb as claimed in claim 1, wherein the closed volume of the chamber is defined by a wall having an open base, and a base cover which closes the open base, at least around the outside of the central core.

6. A bulb as claimed in claim 5, wherein the wall is glass.

7. A bulb as claimed in claim 5, wherein the base cover comprises a plastic ring.

8. A bulb as claimed in claim 1, wherein the closed volume of the chamber is defined by an inner cylinder, which defines the central core, and an outer wall around the inner cylinder.

9. A bulb as claimed in claim 8, wherein the inner cylinder is plastic, metal or ceramic.

10. A bulb as claimed in claim 8, wherein the outer wall is glass.

11. A bulb as claimed in claim 1, wherein the LEDs comprise a string of LEDs provided on a flexible substrate, wherein the flexible substrate is mounted in contact with a radially innermost wall which defines the central core.

12. A bulb as claimed in claim 8, wherein the inner cylinder comprises conductive tracks on which the LEDs are mounted.

* * * * *